US006007384A

United States Patent [19]

Kraemer et al.

[11] Patent Number: 6,007,384

[45] Date of Patent: Dec. 28, 1999

[54] CASING FOR A PLUG FOR A CABLE HAVING A DRAIN WIRE

[75] Inventors: Rudolf Kraemer, Lautertal; Christian Schrettlinger, Bensheim, both of Germany

[73] Assignee: The Whitaker Corporation, Wilmington, Del.

[21] Appl. No.: 09/037,421

[22] Filed: Mar. 10, 1998

[30] Foreign Application Priority Data

Mar. 26, 1997 [DE] Germany ..... 197 12 810

[51] Int. Cl.[6] ..... H01R 9/03

[52] U.S. Cl. ..... 439/610; 439/610; 439/465

[58] Field of Search ..... 439/610, 465

[56] References Cited

U.S. PATENT DOCUMENTS

| | | | |
|---|---|---|---|
| 3,760,326 | 9/1973 | Windsor | 339/14 R |
| 4,632,491 | 12/1986 | Lutz | 339/164 |
| 4,653,836 | 3/1987 | Peele | 449/143 R |
| 4,713,023 | 12/1987 | Bixler et al. | 439/393 |
| 4,747,785 | 5/1988 | Roberts et al. | 439/88 |
| 5,108,313 | 4/1992 | Adams | 439/610 |
| 5,195,909 | 3/1993 | Huss, Jr. et al. | 439/465 |
| 5,505,637 | 4/1996 | Kramer et al. | 439/610 |
| 5,848,914 | 12/1998 | Lang et al. | 439/610 |

FOREIGN PATENT DOCUMENTS

| | | | |
|---|---|---|---|
| 0 125 498-A1 | 11/1984 | European Pat. Off. | H01R 13/502 |
| 33 42 996-C2 | 6/1984 | Germany | H01R 13/58 |
| 35 90 081-T1 | 9/1985 | Germany | H01R 13/58 |
| 92 01 594 | 5/1992 | Germany | H01R 13/658 |
| 41 37 355-C2 | 5/1993 | Germany | H01R 13/52 |
| 43 34 615-C1 | 9/1994 | Germany | H01R 13/658 |

OTHER PUBLICATIONS

Copy of German Search Report.

*Primary Examiner*—Paula Bradley
*Assistant Examiner*—Truc Nguyen
*Attorney, Agent, or Firm*—Driscoll Nina

[57] ABSTRACT

A casing for a shielded connector for a multicore cable having a drain wire, the casing comprising an upper and a lower part, where the drain wire is received in a channel in a first wall region of the lower part and upon assembly is firmly held therein by interacting elevations and depressions on the bottom of the channel and on a complimentary rib of a first wall region of the upper part.

6 Claims, 2 Drawing Sheets

CASING FOR A PLUG FOR A CABLE HAVING A DRAIN WIRE

BACKGROUND OF THE INVENTION

1. Field of the Invention

The invention relates to a cable plug for a cable having a drain wire, in particular a multicore cable.

2. Description of the Prior Art

A drain wire is a non-insulated conductor as component part of a multicore, insulated, shielded cable. Drain wires are used to enable a good connection to the earth potential and to the shield in every part of an electrical connector arrangement. In multicore cables that are shielded with foils, in particular, the drain wire must run near the shield designed as a foil. This enables an additional connection of the shield to the earth potential. At the cable ends, the cable is connected to the contacts of a plug connector. In this case, the drain wire is often connected to an earth potential contact. If no contact locations are available or if it is necessary to save contact locations, the drain wire is directly connected to a metallic part of the plug connector casing. This connection necessitates a separate work step.

SUMMARY OF THE INVENTION

An object therefore arises of specifying a cable plug for a cable having a drain wire which can be assembled with as little work as possible.

This object is achieved by means of a cable plug for a cable having a drain wire, having the following features: a metallic casing; the casing has a cable passageway for receiving the cable, an upper part and a lower part matching the latter; the lower part has, in a first wall region parallel to the cable passageway, a channel which is open at at least one end and serves to receive the drain wire; perpendicularly to the running direction of the channel, the channel has a recess for receiving the free end of the drain wire; the channel has, between the open end and the recess at the bottom of the channel, at least one means for the forced guidance of the drain wire; in a first wall region which interacts with the first wall region of the lower part, the upper part has a rib with complementary means for the forced guidance of the drain wire, in such a way that when the upper part is assembled with the lower part, the drain wire is fixed in the channel by the means for forced guidance.

It is advantageous that the cable plug can be produced in a simple manner from fewer individual parts. This is achieved by virtue of the fact that the upper part and the lower part, matching the latter, of the casing are of hermaphroditic design.

It is furthermore advantageous that the cable plug ensures good shielding. This is achieved by virtue of the fact that the casing has special sealing elements against interference signals, which elements make contact with the shield of the cable. The special sealing elements not only have a sealing effect but also a shielding effect, which is achieved for example by sheathing with a conductive material or by adding conductive particles to the plastic composition.

It is also advantageous that the shield of the cable can be inserted in an uninterrupted manner into the casing of the cable plug. This is achieved by the drain wire being inserted inside the casing behind the region in which the shield is connected to the casing, and is connected to the casing.

It is furthermore advantageous that the drain wire of the cable can be mounted in a simple manner in the cable plug. This is achieved by the upper part being assembled with the lower part, the drain wire is clamped in by means for forced guidance, for example elevations or depressions at the bottom of the channel or on the rib.

It is also advantageous that drain wires having different diameters are firmly held in a satisfactory manner. This is achieved by the recess for receiving the free end of the drain wire being of funnel-shaped design.

It is also advantageous that in the cable plug the cable can be secured against tensile stress. This is achieved by the casing having strain-relief means at the cable entry end.

It is furthermore advantageous that the individual parts of the cable plug can be secured against displacement in the direction of the cable. This is achieved by the rib in the second wall region of the upper part and of the lower part of the casing being of L-shaped design.

DETAILED DESCRIPTION OF THE PREFERRED EMBODIMENT

Figure 1:
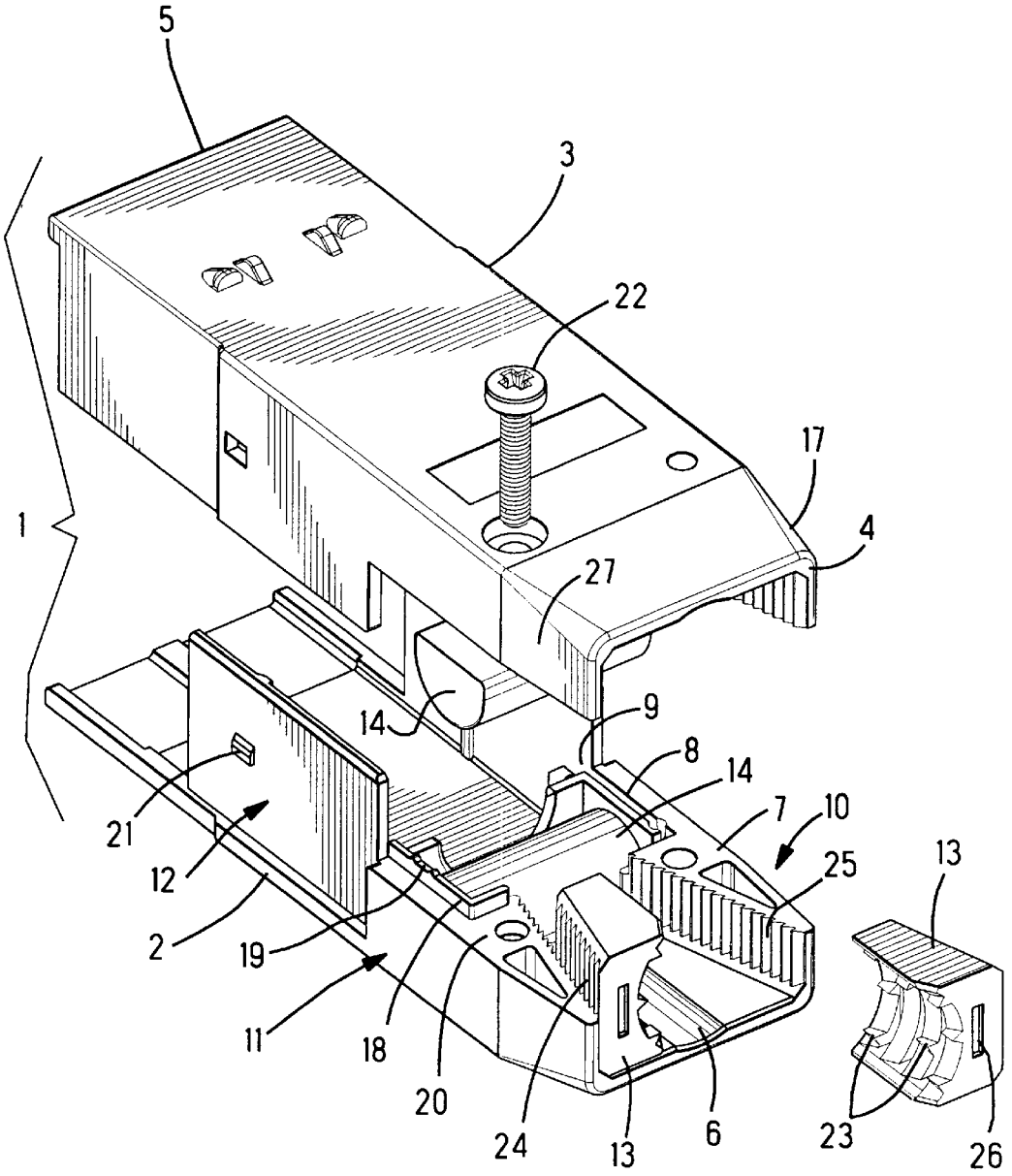
FIG. 1 shows a perspective illustration of a partly exploded cable plug according to the present invention.

FIG. 1 illustrates a casing 1 of a cable plug for a multicore, shielded cable having a drain wire. In order to ensure good shielding, the casing 1 can be produced from a metal, for example from die-cast zinc. The casing 1 comprises a lower part 2 and an upper part 3 matching the lower part 2. The casing 1 extends from a cable entry end 4 to a plug-in face end 5. The casing 1 has a cable passageway 6 for receiving the multicore cable.

The metallic casing 1 serves to receive a multicore, shielded cable which is not illustrated here. Such a cable may comprise a plurality of individually insulated signal lines. When viewed from the outside inwards, the cable comprises the following elements, for example: at least one plastic sheath as insulation, a metallic shield constructed from a metal foil or a metal braid, a plurality of individually insulated signal lines and, inside and adjacent to the shield, at least one drain wire. This drain wire ensures a good earth potential connection.

The lower part 2 has, in a first wall region 7 parallel to the cable passageway 6, a channel 8 which is open at least at one end 9 and serves to receive the drain wire. The drain wire of the multicore cable is introduced into the channel 8 before the assembly of the casing 1. The metallic casing 1 fulfils a number of tasks: it increases the robustness of the plug connector; it ensures shielding of the individual lines in the region between the cable entry end 4 and the plug-in face end 5; it enables strain relief of the cable and it establishes the connection between the shield of the cable and the casing 1. For the purposes thereof, the casing 1 comprises the following regions, seen one after the other: a strain-relief region 10, which adjoins the cable entry end 4; a sealing region 11 and a shielded contact-receiving region 12 which ends with the plug-in face end 5.

Two strain-relief wedges 13 are arranged in the strain-relief region 10. Two special sealing elements 14 are arranged perpendicularly to the cable passageway 6 in the sealing region 11. The sealing elements 14 comprise a flexible plastic profile which is rendered electrically conductive by sheathing it with a metallic braid. The special sealing element 4 can also be rendered conductive by mixing electrically conductive particles, such as carbon black or metal particles, with the plastic composition. In the non-pressed-together state, the sealing element 14 has a semi-circular profile. In the pressed-together state, the special sealing element 14 ensures that the casing 1 is sealed against dust and, at the same time, a good electrical connection is made to the shield of the metallic casing 1. A plug part (not illustrated) with a plurality of contact chambers for receiving contact elements is arranged in the shielded contact receiving region 12.

When the plug connector is assembled, the cable, which has been prepared for connection, is firstly inserted into the cable passageway 6 in the lower part 2. The outer insulation of the cable reaches as far as the end of the strain-relief region 10, up to the start of the sealing and shielding region 11. The shielding runs from the end of the strain-relief region 10 to the end of the sealing and shielding region 11. The individually insulated signal conductors and the drain wire reach further into the casing 1. The drain wire can thus be connected to the metallic casing 1 without interrupting the shielding.

Figure 2:
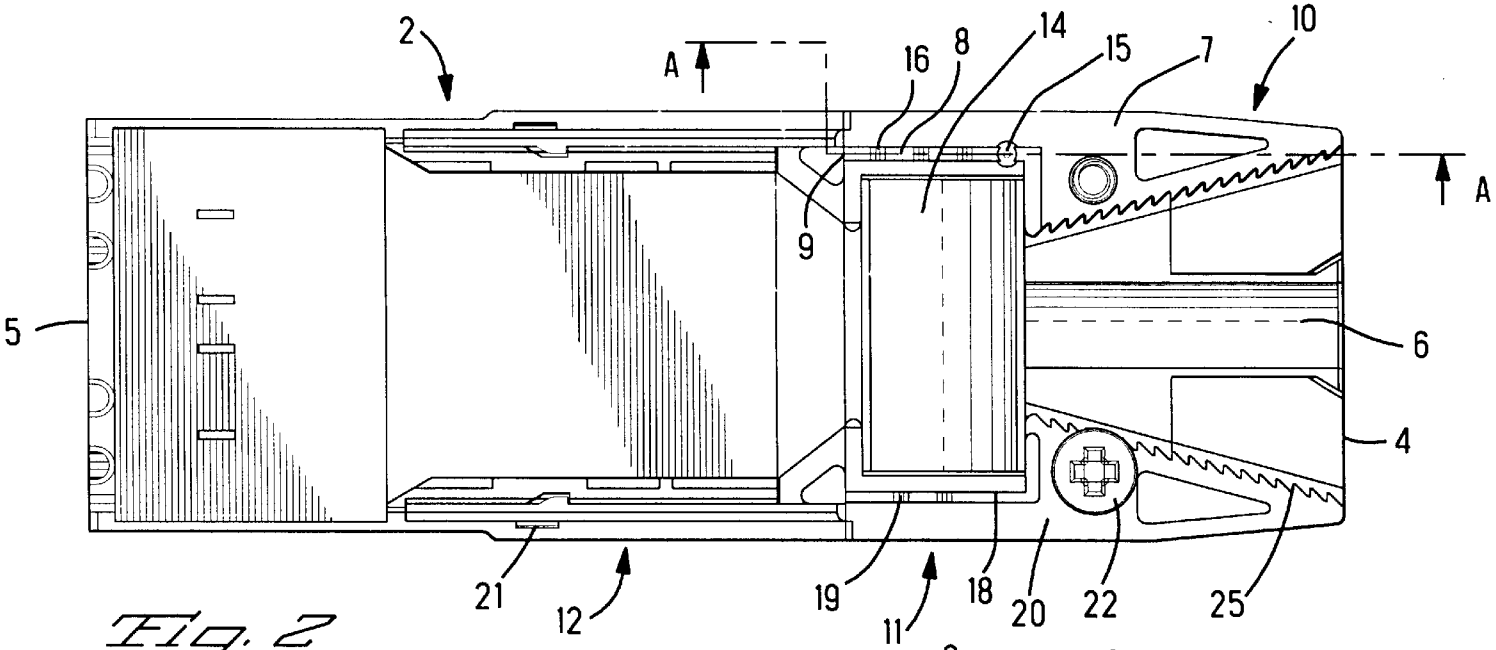
FIG. 2 shows a view of a lower part of the opened cable plug of FIG. 1.

FIG. 2 illustrates a view of the lower part 2. The various regions 10, 11, 12 of the casing 1 can be seen here. It is also possible to see that the channel 8 runs parallel to the cable passageway 6 into the first wall region 7. A recess 15 perpendicular to the running direction of the channel 8 is illustrated in the channel 8. The free end of the drain wire is received in this recess 15. When the plug connector is assembled, firstly the free end of the drain wire is introduced into the recess 15, then the drain wire is bent approximately at right angles and inserted into the channel 8, whereupon the drain wire is once again bent at right angles in the direction of the axis of the cable bushing 6 and inserted together with the remaining individually insulated conductors inside the shield into the sealing region 11.

Figure 3:
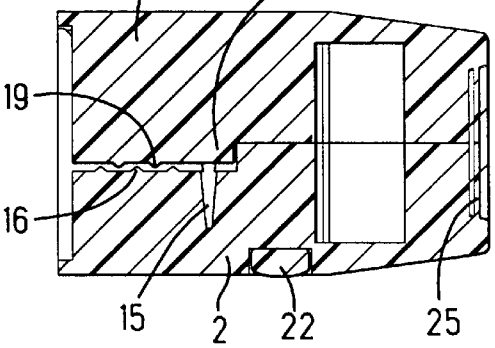
FIG. 3 shows a section through the lower part view taken along line A—A of FIG. 2 with the upper part of the cable plug of FIG. 1, in the assembled state.

FIG. 3 illustrates a section through the casing 1 after assembly, the section being taken along the line AA of FIG. 2. The section AA has been placed in the middle of the channel 8 and in the longitudinal direction thereof. FIG. 3 reveals that the channel 8 has, between the open end 9 and the recess 15 at the bottom of the channel 8, three means 16 for the forced guidance of the drain wire, in this case three prism-shaped elevations. The upper part 3 has a rib 18 in a first wall region 17 which interacts with the first wall region 7 of the lower part 2. This rib 18 likewise has means 19 for the forced guidance of the drain wire, in this case two prism-shaped elevations. When the upper part 3 is assembled with the lower part 2, these means 16, 19 for the forced guidance of the drain wire interact with one another in such a way that the drain wire is firmly held in the channel 8 by the means 16, 19 for forced guidance. The means 16, 19 for forced guidance, in this case the prism-shaped elevations, ensure that the drain wire makes reliable contact with the metallic casing 1. FIG. 3 also reveals how the depression 15 is of funnel-shaped design. The effect achieved by the funnel shape of the recess 15 is that drain wires having different diameters can be firmly held.

The lower part 2 and the upper part 3 of the casing 1 may be of hermaphroditic design. This has the advantage that only a single die-casting mould has to be produced for the lower part 2 and for the upper part 3. It also facilitates assembly, since it is not necessary to sort out upper and lower parts. Since the lower part 2 and the upper part 3 are configured identically, the second wall region 20 of the lower part 2 likewise has a rib 18 with means 19 for the forced guidance of the drain wire.

FIG. 1 reveals the rib 18 having an L-shaped configuration. The effect of the L-shaped configuration of the rib 18 is that the casing parts 2, 3 are secured against displacement. A further effect achieved by the L-shaped configuration of the rib 18 is that the cable plug is well shielded against externally incident electromagnetic radiation, because the L-shaped ribs 18 represent baffles to the incident radiation. The lower part 2 and the upper part 3 are held together by latches 21 in the contact receiving region 12. The lower part 2 and the upper part 3 are held together by a screw 22. After the casing 1 has been screwed together, the semicircular profiles of the special sealing elements 14 are pressed together and ensure good sealing and contact-making of the shield.

The strain-relief wedges 13 (FIG. 1) at the cable passageway 6 are pressed in on opposite sides of the sheath of the cable. On their inner side, the strain-relief wedges 13 have a plurality of teeth 23, which engage in the sheath material of the cable. On their outer side, the strain-relief wedges 13 have a fine toothing 24, which interacts with a complementary toothing 25 on the casing 1. As a result of this toothing 24, 25, the strain-relief wedge 13 can be pressed into the casing 1 in the direction of the cable passageway 6 and be firmly held. The strain-relief wedge 13 has a slot 26, into which a screwdriver can be inserted. This makes it possible to exert a greater pressure on the strain-relief wedges 13. It is conceivable to use strain-relief wedges 13 of different sizes. This makes it possible for different cables of varying sheath diameter to be firmly held in a satisfactory manner in the same cable plug. The cable plug is used for shielded cables having a multiplicity of individual, insulated conductors with at least one drain wire for earth potential connection.

We claim:

1. A casing for a plug to be attached to a cable having a drain wire with a free end, the casing comprising an upper part and a lower part complimentary to the latter, the casing extending from a mating portion to a cable receiving portion and having a passageway for receiving the cable, where the lower part has along the passageway a first wall region with a channel with a longitudinal axis parallel to the passageway and open for receiving the free end of the drain wire, where the upper part has a rib receivable between sidewalls of the channel in such a way that upon assembly of the upper part with the lower part the drain wire will be fixed in the channel between the rib and bottom of the channel, and the bottom of the channel and the rib comprise interacting elevations and depressions for the purpose of forced guidance of the drain wire.

2. The casing according to claim 1, wherein the upper part and the lower part are of hermaphroditic design.

3. The casing according to claim 1, where the channel has a recess for receiving the free end of the drain wire perpendicular to the logitudinal axis of the channel.

4. The casing according to claim 1, where the ribs are L-shaped.

5. The casing according to claim 1, where the casing has a sealing region, conductive sealing elements are disposed therein for sealing about the cable and for contacting a shielding of the cable, whereby the cable shielding is connected to the casing.

6. The casing according to claim 1, where the casing has a strain-relief region wherein strain-relief wedges for firmly holding the cable are disposed.

* * * * *